US009126089B2

(12) United States Patent
Spiegel

(10) Patent No.: US 9,126,089 B2
(45) Date of Patent: Sep. 8, 2015

(54) FOOTBALL TEE WITH ANGULARLY ADJUSTABLE BALL SUPPORT

(71) Applicant: H. Jay Spiegel, Mount Vernon, VA (US)

(72) Inventor: H. Jay Spiegel, Mount Vernon, VA (US)

( * ) Notice: Subject to any disclaimer, the term of this patent is extended or adjusted under 35 U.S.C. 154(b) by 0 days.

(21) Appl. No.: 14/142,229

(22) Filed: Dec. 27, 2013

(65) Prior Publication Data

US 2015/0182832 A1 Jul. 2, 2015

(51) Int. Cl.
*A63B 69/00* (2006.01)

(52) U.S. Cl.
CPC ..... *A63B 69/0075* (2013.01); *A63B 69/002* (2013.01); *A63B 2243/007* (2013.01); *A63B 2243/0025* (2013.01)

(58) Field of Classification Search
CPC ... A63B 69/00; A63B 69/0075; A63B 69/002
USPC ..... 473/20, 419, 417, 420, 438, 387, 396; D21/716, 715, 717, 718
See application file for complete search history.

(56) References Cited

U.S. PATENT DOCUMENTS

| | | | | | |
|---|---|---|---|---|---|
| 3,087,726 | A | * | 4/1963 | Pogue | 473/420 |
| 4,019,735 | A | * | 4/1977 | Thompson | 473/420 |
| 4,049,267 | A | * | 9/1977 | Forrest | 473/419 |
| D277,973 | S | * | 3/1985 | Stenerud | D21/716 |
| 4,537,397 | A | * | 8/1985 | Kopp | 473/420 |
| 4,655,453 | A | * | 4/1987 | Spiegel et al. | 473/420 |
| 4,657,252 | A | * | 4/1987 | Spiegel | 473/420 |
| D291,714 | S | * | 9/1987 | Spiegel | D21/716 |
| D305,448 | S | * | 1/1990 | Spiegel | D21/716 |
| 5,100,135 | A | * | 3/1992 | Bourgeois | 473/420 |
| 5,368,294 | A | * | 11/1994 | Mathey | 473/419 |
| D372,062 | S | * | 7/1996 | Spiegel | D21/716 |
| D383,816 | S | * | 9/1997 | Spiegel | D21/716 |
| D392,705 | S | * | 3/1998 | Spiegel | D21/716 |
| 6,309,316 | B1 | * | 10/2001 | Spiegel | 473/420 |
| D489,779 | S | * | 5/2004 | Spiegel | D21/716 |
| D507,315 | S | * | 7/2005 | Spiegel | D21/716 |
| D507,814 | S | * | 7/2005 | Spiegel | D21/716 |
| D513,775 | S | * | 1/2006 | Spiegel | D21/716 |
| D634,798 | S | * | 3/2011 | Suisham et al. | D21/717 |
| 8,517,864 | B2 | * | 8/2013 | Spiegel | 473/420 |
| 2014/0349784 | A1 | * | 11/2014 | Holland | 473/420 |

FOREIGN PATENT DOCUMENTS

| | | | | | |
|---|---|---|---|---|---|
| WO | WO 2004020052 | A1 | * | 3/2004 | A63B 69/00 |
| WO | WO 2006024053 | A1 | * | 3/2006 | A63B 69/00 |

* cited by examiner

*Primary Examiner* — Mitra Aryanpour
(74) *Attorney, Agent, or Firm* — H. Jay Spiegel

(57) ABSTRACT

The present invention includes a ball receiving recess carried by a pivotable support structure. This support structure may be pivoted to the left or right to allow the ball receiving recess to be angulated with respect to vertical. The sides of the support structure include openings and elongated slots are formed within the football tee base aligned with the side openings in the support structure. An arm includes an elongated rod receivable within either opening in the football tee base, but rotatable with respect thereto. The arm includes an arcuate portion and an end distal from the rod including a wedge-like end having a narrow edge engaging within a seam of a football. The slots interengage with the rod of the arm to provide a limit stop mechanism, limiting the degree of lateral pivoting of the support structure.

21 Claims, 9 Drawing Sheets

FOOTBALL TEE WITH ANGULARLY ADJUSTABLE BALL SUPPORT

BACKGROUND OF THE INVENTION

The present invention relates to a football tee with angularly adjustable ball support. In the prior art, H. Jay Spiegel, inventor herein, has invented a number of football kicking tees for supporting an American-style football for kickoffs, five of which are commercialized as of this date. These tees are displayed and discussed at the website accessible at www.4-tees.com and include:

(1) The GROUND ZERO®-1 tee which has been used in every National Football League (NFL) game over the past 15 seasons;

(2) The GROUND ZERO ONSIDE® tee which is the most popular tee in U.S. colleges;

(3) The GROUND ZERO®-2 and TOE-TAL® tees which are the most popular high school tees; and the TRIPLEX® STEALTH® tee was introduced in 2012 and is gaining in popularity in high schools and colleges.

The GROUND ZERO®-1 and GROUND ZERO®-2 tees are covered by U.S. Pat. Nos. 4,655,453; 4,657,252; and D383,816, and by U.S. Federal Trade Dress Registration Nos. 4,146,833 and 4,375,441. The TOE-TAL® tee is covered by U.S. Pat. Nos. 4,655,453; 4,657,252; D291,714; D372,062; D383,816; D383,817; and D392,705, and by U.S. Federal Trade Dress Registration Nos. 4,375,463, 4,375,441; and 4,375,439. The GROUND ZERO ONSIDE® tee is covered by U.S. Pat. Nos. 6,309,316; D489,779; D507,315; D507,814; and D513,775, and by U.S. Trade Dress Registration No. 4,146,833. The TRIPLEX® STEALTH® tee is covered by U.S. Pat. Nos. 8,517,864; 8,602,918; D678,437; D634,798; and D664,221, and by U.S. Federal Trade Dress Registration No. 4,146,833.

As anyone who watches NFL football games knows, the GROUND ZERO®-1 tee allows kickers to kick the ball off through the end zone on a fly. Similarly, kickers who use the GROUND ZERO ONSIDE® tee in colleges are often able to kick off a football through the end zone on a fly. The GROUND ZERO®-2 tee and TOE-TAL® tee frequently allow high school kickers to achieve touch backs by kicking the football into the end zone or through the end zone as the case may be. Kickers have found that the TRIPLEX® STEALTH® tee even enhances the distance achievable with the other tees through its reduction in the surface area of contact between the tee and the ball. As such, enhanced results have often been observed.

Thus, while the results achievable through the use of the five football tees described above appear to adequately provide place kickers with ball support while permitting high levels of performance, it is always appropriate to seek further improvements whenever possible. In this regard, some kickers believe that performance of kickoffs is enhanced when the football is able to be supported with a laterally angulated lean. They contend that such a lean allows a cleaner "hit" on the football with enhanced results. In this regard, Garrett C. Palmer of San Diego, Calif., a former college kicker, has invented a tee that he markets through his company Genesis Pro Sports under the name "JAWBONE." The JAWBONE tee has a version covered by U.S. Pat. No. D656,568 and contemplates a flat platform supporting the ball which leans backward against a surface and is supported in the forward direction by a plurality of upstanding bristles which supposedly permit support of the ball at a slight lateral angulation. Inventor Palmer describes and discusses performance of the JAWBONE tee on a YouTube video accessible at http://www.youtube.com/watch?v=XBLYZzVJK_o. In the video, Mr. Palmer explains that the JAWBONE tee is intended to permit support of a football with a 6° side angulation and a 2° forward angulation. In this regard, it is noted that the five tees described above all permit the 2° forward angulation but may not permit a 6° side angulation. However, in viewing the JAWBONE video, it is noted that at the end of the video, Mr. Palmer kicks a football off the JAWBONE tee and it is apparent that the tee moves upon impact with the football by Mr. Palmer's foot. What this means is that the JAWBONE tee is unable to support a football so that it may be kicked from the JAWBONE tee without resistance. Resistance equals reduced distance and elevation. By contrast, as anyone who has observed the five Spiegel tees can state, it is easily achievable to kick a football off of any of those tees without any tee movement at all. This means a kicker is getting a clean hit on the football and is able to drive the football down field with optimal distance and elevation.

U.S. Pat. No. 5,100,135 to Bourgeois discloses a football kicking tee support that includes two pivotable hinges to which are attached upstanding metal wire contoured arms that are designed to engage side surfaces of a football above its tip with spaced pads. As Bourgeois explains the operation of his tee, when a kicker wishes to kick a football, his toe first contacts the pivoting gates and swings them to the open position which causes the metal wire contoured arms to pivot away from the football. Applicant is unaware of any commercialization of the Bourgeois tee. This is not surprising because any tee that includes, as a design feature, the concept of actually striking the tee intentionally before striking the ball is unfeasible. When a kicker strikes the tee before striking the ball, the ball is inherently dislodged from its originally supported position and thus the kicker is always unable to obtain a clean hit on the football. The present invention distinguishes from Bourgeois as contemplating a tee in which one upstanding arm may support the football in conjunction with a ball receiving recess, but the arm is only able to pivot forward in the direction of motion of the kicker's foot to eliminate any possible resistance to kicking the ball.

U.S. Pat. No. 4,655,453 was issued to Applicant herein and his co-inventor Louis R. Groza otherwise known as Lou "the toe" Groza, the kicker who is widely recognized as making the field goal an important offensive weapon in the game of football. Mr. Groza is a member of the NFL Hall of Fame and the National High School Federation Hall of Fame, and retired in 1968 as the all-time leading scorer in NFL history and was also Most Valuable Player in the NFL in 1954. While his scoring record has since been eclipsed, his place in football history is secure and remembered every year as the award for best Division 1 college kicker is called the Lou Groza Award.

FIG. 19 of this patent is reproduced herein as FIG. 15 and shows a prior art design, never commercialized, which contemplates a base 11' with outer wall 26' and bottom 13 with surface texture 126', a bottom surface having a ball receiving recess 27' shaped like the surfaces of an oblate spheroidal American-style football adjacent the tip thereof with the recess supported in an insert 25' having an outer spherical surface 43' designed to fit within inner spherical surfaces of a recess 15' (with a bottom wall 41') and 36' of a locking plug 30' having tool receiving recess 38'. As disclosed at column 12, lines 23-25, this configuration allows the insert 25' to be "moved to an infinite variety of angles with respect to the base 11' to allow tilt adjustment of a ball inserted therein . . . ". Legs 104 and 108 are partially shown. As seen with reference to FIG. 15, the tilt adjustment of the insert 25' is severely limited by the location of the flat bottom wall 41' which limits the tilting ability of the insert 25' to small angles. Furthermore, as subsequent experience has revealed, when a football is supported in a ball receiving recess, rather than by upstanding prongs, the degree of tilt of the football is limited in the absence of additional side ball support. This concept was nowhere contemplated by the '453 patent, and the present invention distinguishes therefrom as contemplating an upstanding arm designed to achieve this result.

SUMMARY OF THE INVENTION

The present invention relates to a football tee with angularly adjustable ball support. The present invention includes the following interrelated objects, aspects and features:

(1) In a first aspect, the present invention shares in common with Applicant's earlier patents the concept of a recess shaped like the surfaces adjacent the tip of an oblate spheroidal American-style football to support the football for place kicking. The recess also includes a forward opening framed by opposed ribs leading to a second recess sized to permit the football to leave the tee without resistance. If desired, the ball receiving recess may include the reduced surface area features of Applicant's prior U.S. Pat. Nos. 8,517,684 and 8,602,918.

(2) In the preferred embodiment of the present invention, the ball receiving recess, ribs, and the rearward end of the second recess are carried on a laterally pivotable support structure. This support structure may be pivoted from a central position to the left or to the right to allow the ball receiving recess to be angulated with respect to vertical by an angulation of up to, for example, 10°.

(3) The laterally pivotable support structure has a bottom surface that is part cylindrical and is received in a corresponding part cylindrical recess in the football tee base. These interengaging part cylindrical surfaces allow smooth pivoting of the support structure side to side. If desired, at least one rod or stem may protrude from the support structure and be received within a hole in the football tee base to facilitate controlled pivoting of the support structure with respect to the base. In this regard, the rod or stem not only holds the support structure in place within the football tee base, but also, it has a circular cross-section closely and frictionally received within a corresponding opening in the football tee base permitting the user to pivot the support structure by applying force thereto with the frictional interengagement causing the support structure to be maintained at the angulation with respect to the base as set by the user.

(4) The left hand and right hand sides of the support structure include circular cross-section openings, preferably aligned with the locations where the diametrically opposite sides of the football with respect to the laces will be located when the football is placed within the ball receiving recess. Elongated slots are formed within the football tee base aligned with the side openings in the support structure. An arm includes an elongated rod or stem sized to be receivable within either opening in the football tee base, but rotatable with respect thereto. The arm includes an arcuate portion and an end distal from the rod or stem which includes a wedge-like end having a narrow termination edge sized to engage within a seam of a football. The slots interengage with the rod or stem of the arm to provide a limit stop mechanism, limiting the degree of lateral pivoting of the support structure. Thus, the length of each slot may be determined to limit the degree of pivoting to, for example, 10° from vertical. The support structure is laterally adjustable in either direction within the limits of the elongated slot within which the rod or stem of the arcuate arm is inserted. In the preferred embodiment, indicia may be placed next to each slot demarking the number of degrees of angulation based upon the position of the rod or stem of the arcuate arm within a slot.

(5) In operation, the arcuate arm is placed through one of the slots and received within the corresponding opening in the side of the support structure. The support structure is pivoted to the desired degree of angulation based upon the indicia on the side of the slot. It is noted that for a right footed kicker, typically, the kicker will wish to install the arcuate arm on the right hand side of the tee and, conversely, a left footed kicker will wish to install the arcuate arm on the left hand side of the tee base. With the angulation appropriately set, a football is inserted into the ball receiving recess with a wedge-like end of the arcuate arm received within the side seam of the ball. When the ball is kicked, any possible resistance that might be caused by the interaction between the wedge-like end of the arcuate arm and the football is eliminated by virtue of the fact that the rod or stem may pivot with respect to the opening formed in the support structure so that the arcuate arm may pivot forward as the ball is leaving the tee.

(6) In this way, the kicker may support a football within the inventive tee matching the angulation of the football with the angulation of the kicker's foot on impact. This matching of the respective angulations of foot and football enhances the impact of the kicker's foot on the ball.

As such, it is a first object of the present invention to provide a football tee with angularly adjustable ball support.

It is a further object of the present invention to provide such a football tee with a recess designed to support surfaces of a football adjacent its tip and to permit lateral adjustment of the angulation of the ball with respect to the tee.

It is a still further object of the present invention to provide such a football tee with the ability to adjust angulation to the left or to the right with equal effectiveness.

It is a still further object of the present invention to provide such a football tee which includes a support structure having a cylindrical bottom surface designed to be received by a cylindrical upper surface of a football tee base.

It is a yet further object of the present invention to provide such a football tee with an arcuate arm attachable on either side of the support structure to accommodate to pivoting in the left hand or right hand direction.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
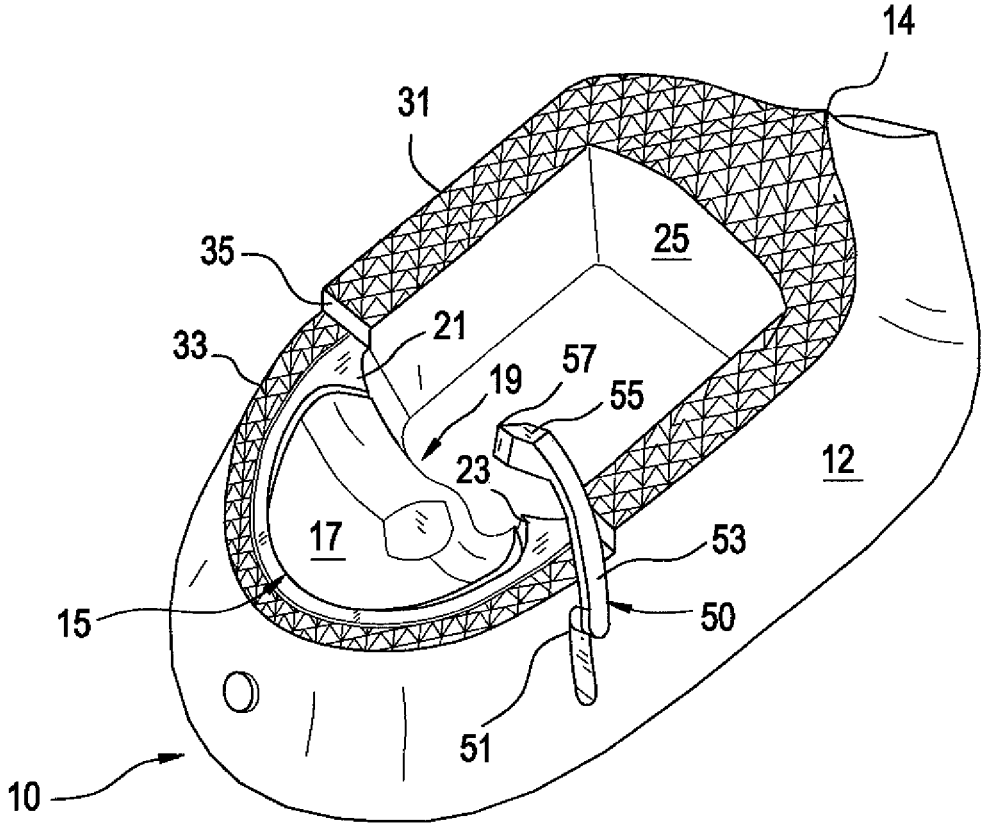
FIG. 1 shows a rear side above perspective view of the present invention with the arcuate arm supported on its right hand side.

With reference to the figures, the present invention is generally designated by the reference numeral 10 and is seen to include a base 12 and a laterally pivotable support structure 15 attached. The support structure 15 includes a recess 17 shaped in general conformance with the surface of an oblate spheroidal football adjacent the tip thereof. The recess 17 has a forward opening 19 framed by ribs 21 and 23 which lead to a second recess 25 sized and configured to allow the tip of a football, when kicked, to easily escape the tee 10 without obstruction.

If desired, the surfaces of the recess 17 may correspond to the configuration shown in FIG. 20 of U.S. Pat. No. 4,655,453 or, alternatively, may take on one of the surface configurations shown in U.S. Pat. No. 4,517,864 or 8,602,918. In particular, those surface configurations reduce the surface area of contact between surfaces of a football adjacent its tip by providing areas described as bands, lines or semi-spherical projections to reduce the surface area of contact between the tee and the football. In the configuration shown, the base 12 has a forward facing pointed end 14 that is intended to facilitate aiming the tee in the desired direction. Of course, if desired, the point 14 can be replaced with other suitable structure such as, for example, the onside kick recess disclosed and claimed in U.S. Pat. No. 6,309,316 or as shown in any one of U.S. Pat. Nos. D489,779, D507,315, D507,814 and D513,775.

Figure 2:
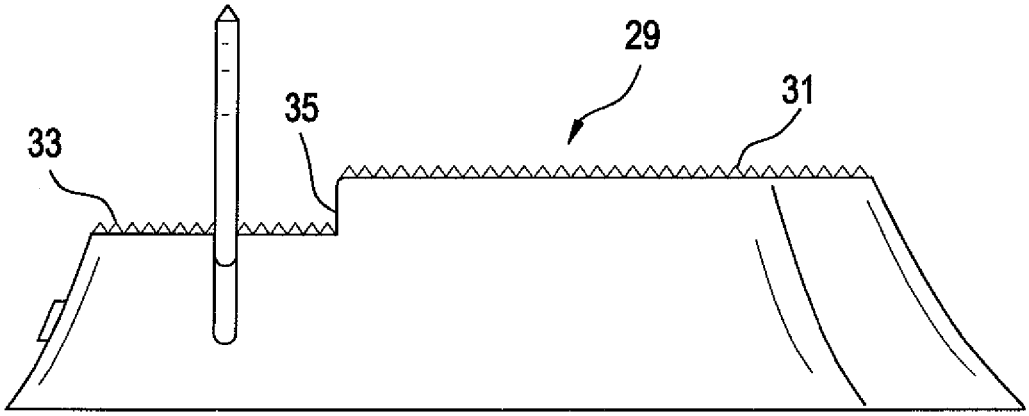
FIG. 2 shows a side view of the configuration shown in FIG. 1.
Figure 3:
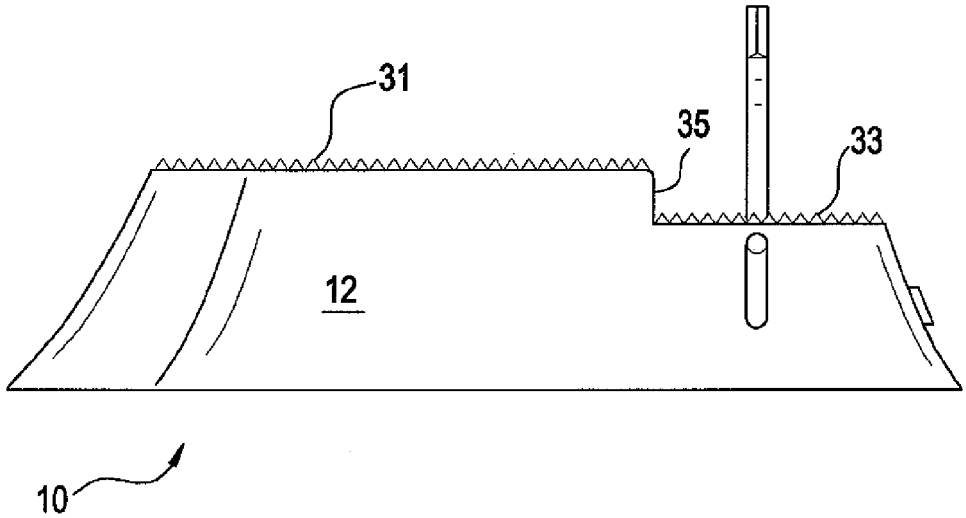
FIG. 3 shows a view from the other side of the view of FIG. 2.
Figure 4:
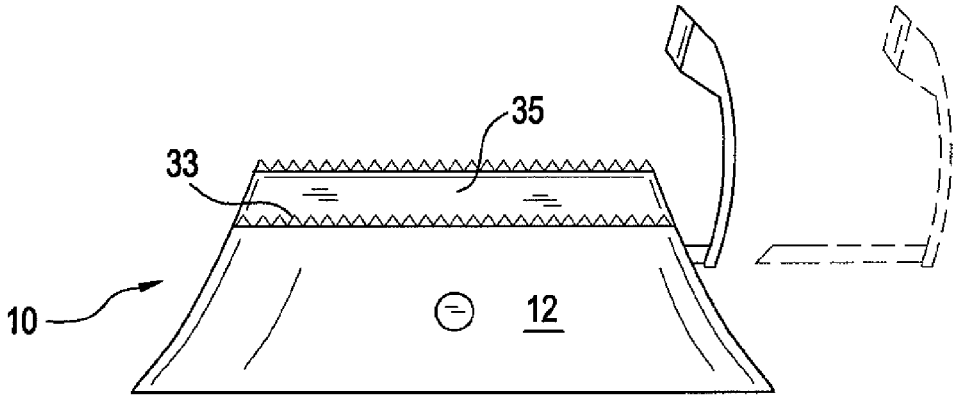
FIG. 4 shows a rear view of the configuration of FIGS. 1-3.
Figure 5:
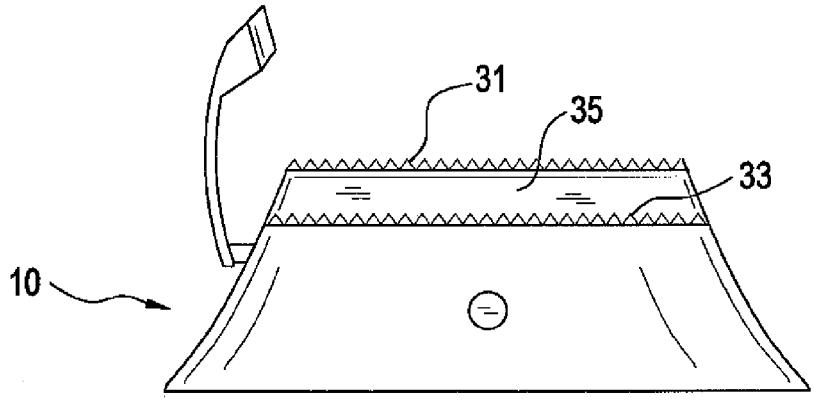
FIG. 5 shows a view similar to that of FIG. 4 but with the arcuate arm supported on the left hand side of the tee base.
Figure 6:
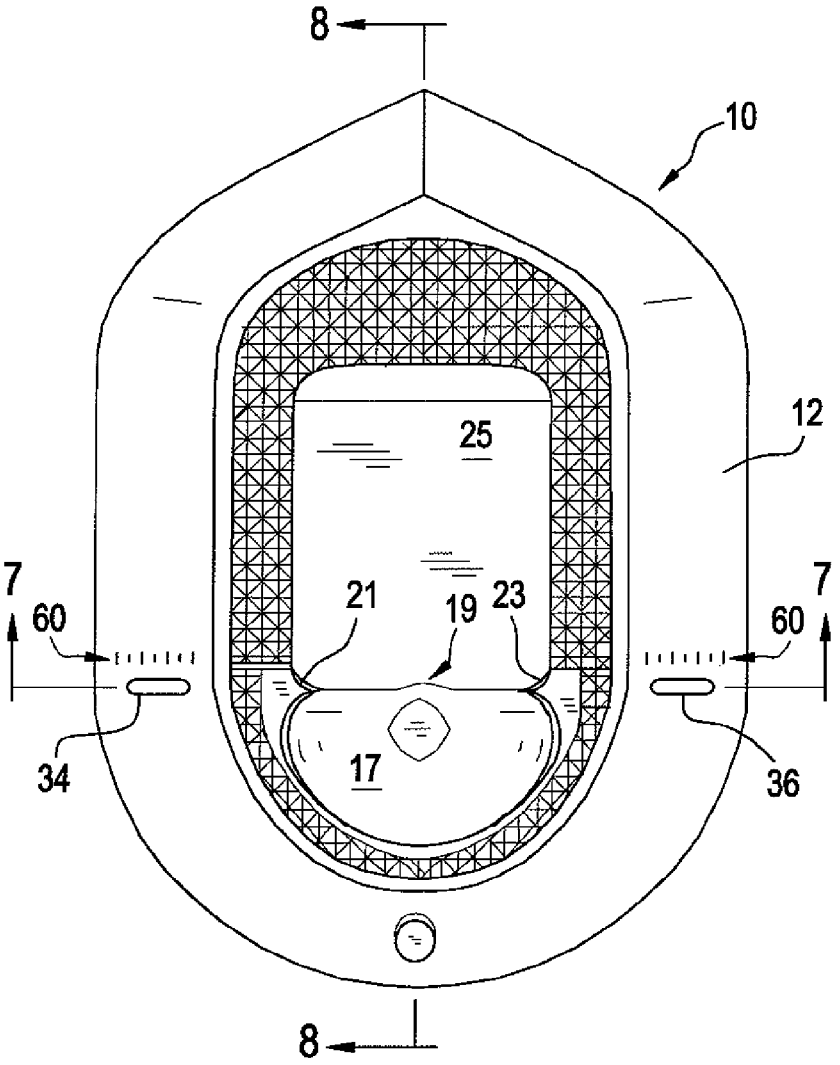
FIG. 6 shows a top view of the present invention.

As seen in, for example, FIG. 2, the base 12 has a top surface 29 that is stepped having an upper stepped portion 31 and a lower stepped portion 33 interconnected at a shoulder 35. The surfaces 31 and 33 are covered with contiguous four-sided pyramid-shaped projections which are provided solely for the purpose of ornamentation. As seen in FIG. 6, the base 12 includes a pair of laterally opposed slots 34 and 36 for a purpose to be described in greater detail hereinafter.

Figure 7:
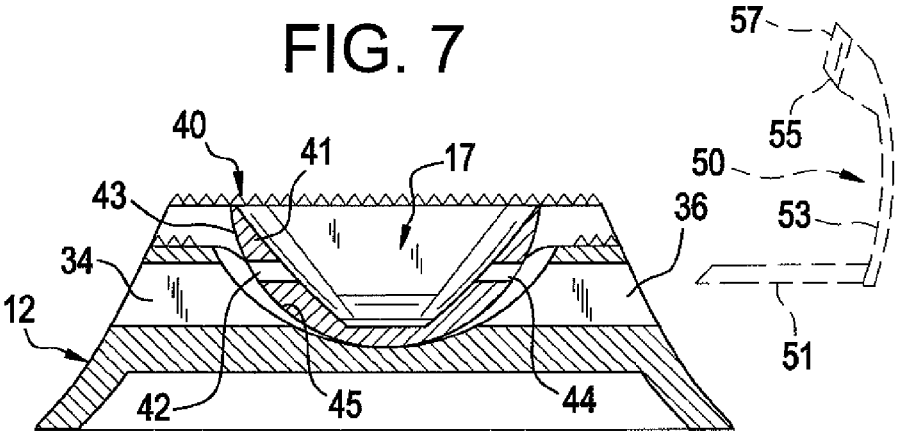
FIG. 7 shows a cross-sectional view along the line 7-7 of FIG. 6.
Figure 8:
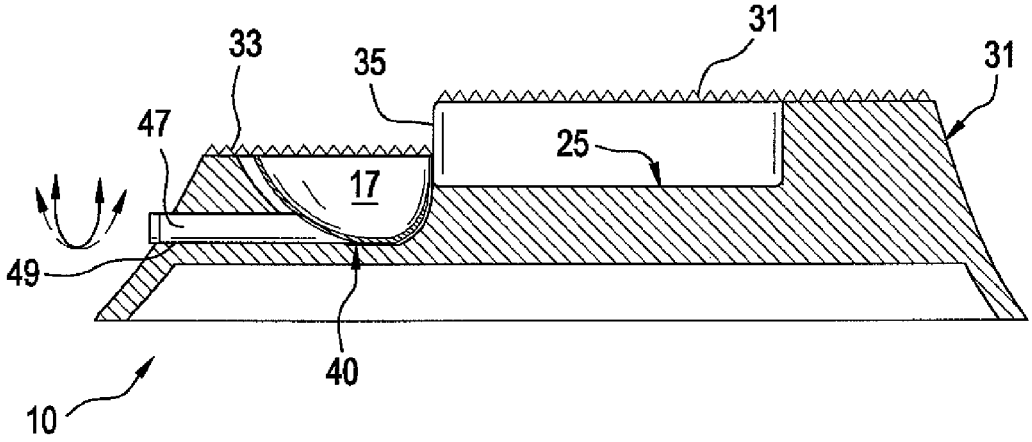
FIG. 8 shows a cross-sectional view along the line 8-8 of FIG. 6.
Figure 9:
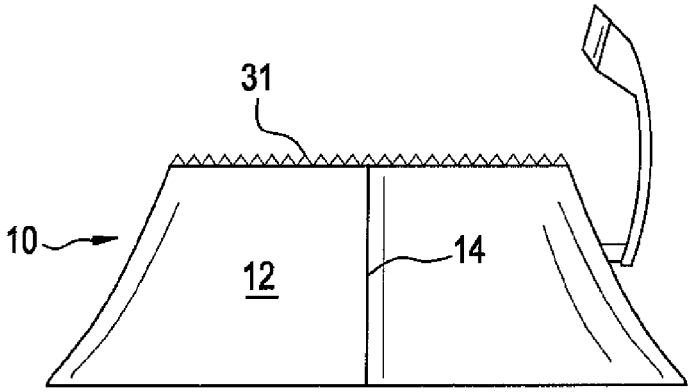
FIG. 9 shows a front view of the configuration of FIG. 5.
Figure 10:
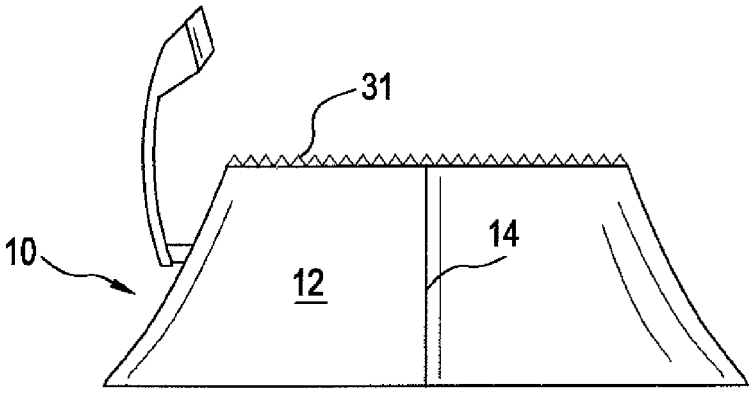
FIG. 10 shows a front view of the configuration of FIGS. 1-4.

With reference now to FIG. 7, the inventive laterally pivotable support structure will be better understood with reference to, first, FIG. 7. The laterally pivotable support structure is generally designated by the reference numeral 40 and includes a body 41 having an outer cylindrical surface 43 designed to slidably rotate on a cylindrical surface 45 on the tee base 12. As seen in FIG. 8, the support structure 40 may include a stem or rod 47 extending rearwardly through a passageway 49 in the base to allow controllable pivoting movements left and right with respect to the base 12. The ball receiving recess 17 is carried on the support structure 40. The support structure 40 also includes holes 42 and 44 for a purpose to be described in greater detail hereinafter.

An arcuate arm 50 (FIGS. 1-5) includes a rod or stem 51 sized to be receivable in either opening 42 or 44 on the support structure 40. The holes 42 and 44 and the stem or rod 51 have circular cross-sections enabling the arcuate arm 50 to pivot on the rod or stem 51 when force is applied to the arcuate arm 50, such as by the user's foot when a football supported by the tee 10 is kicked. The arcuate arm 50 includes an arm 53 that extends from the rod or stem 51 in an arcuate fashion such that when it is inserted into one of the holes 42 or 44, it may pivot forward.

At the end of the arm 53 remote from the rod or stem 51, it terminates in a wedge-like body 55 having a distal edge 57 sized and configured to be received within a seam of a football. This is best seen with reference to FIG. 1.

Figure 12:
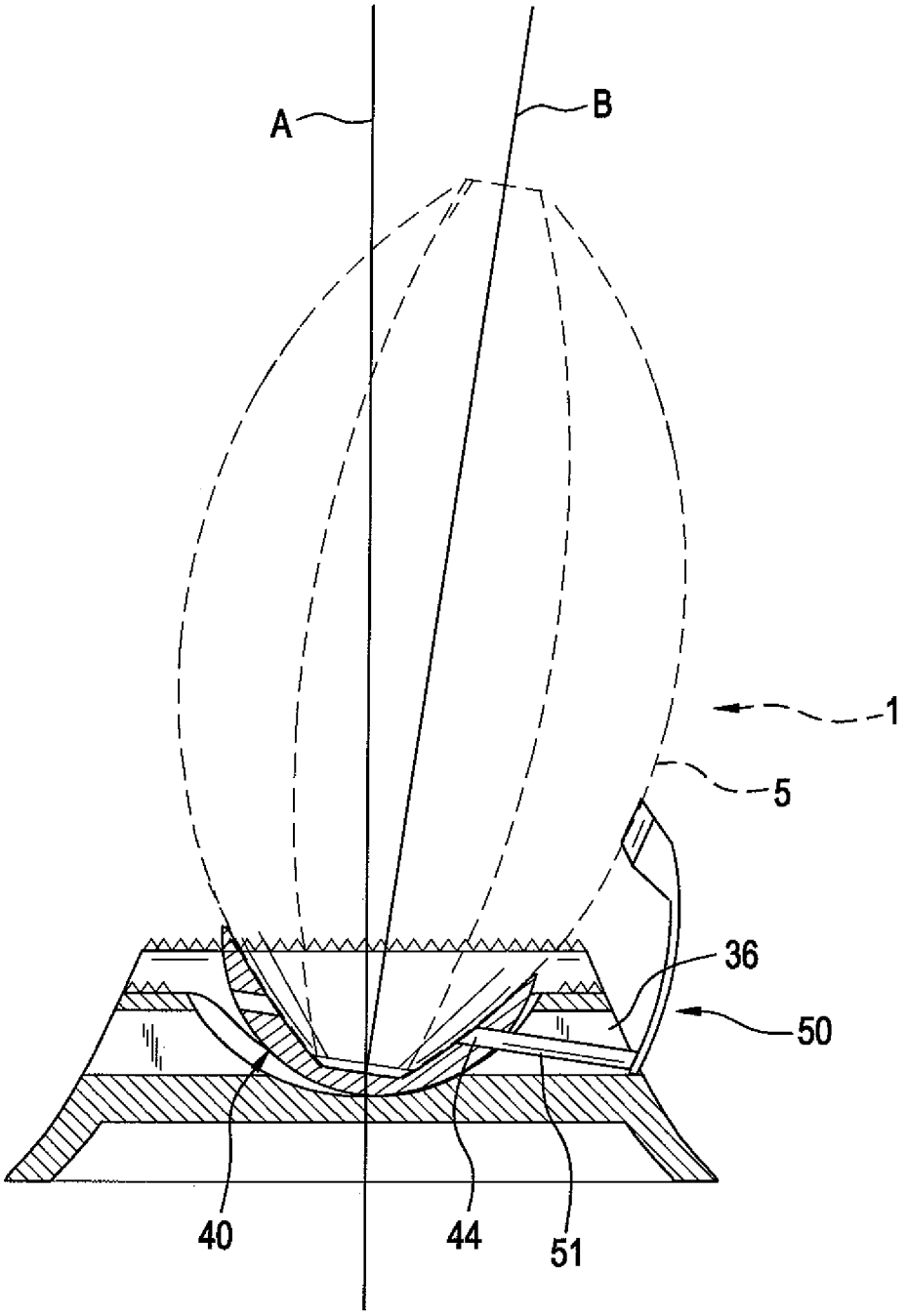
FIG. 12 shows a cross-sectional view similar to that of FIG. 7 but showing the support structure pivoted in the right hand direction and with a football shown in phantom supported thereon.

As seen with particular reference to FIG. 12, the football 1 placed within the recess 17, and the arcuate arm 50 inserted within the hole 44 via the slot 36, the football 1 and the support structure 40 may be pivoted to the right until the rod or stem 51 engages the bottom of the slot 36 which acts as a limit stop to further pivoting. As seen in FIG. 12, the vertical axis is designated by the letter "A" and the axis of the football in the configuration shown in FIG. 12 is designated by the reference letter "B." The angle between the lines A and B is approximately 10° denoting the maximum angular movement of the support structure 40 from the vertical axis A. Of course, this particular angle is merely exemplary and the slots 34 and 36 may be lengthened or shortened to provide larger or smaller degrees of potential angulation. With reference to FIG. 6, indicia 60 may be provided adjacent each slot 34, 36 to provide the user information concerning the exact degree of angulation by degrees based upon the position of the rod or stem 51 within the slot 34 or 36.

Figure 13:
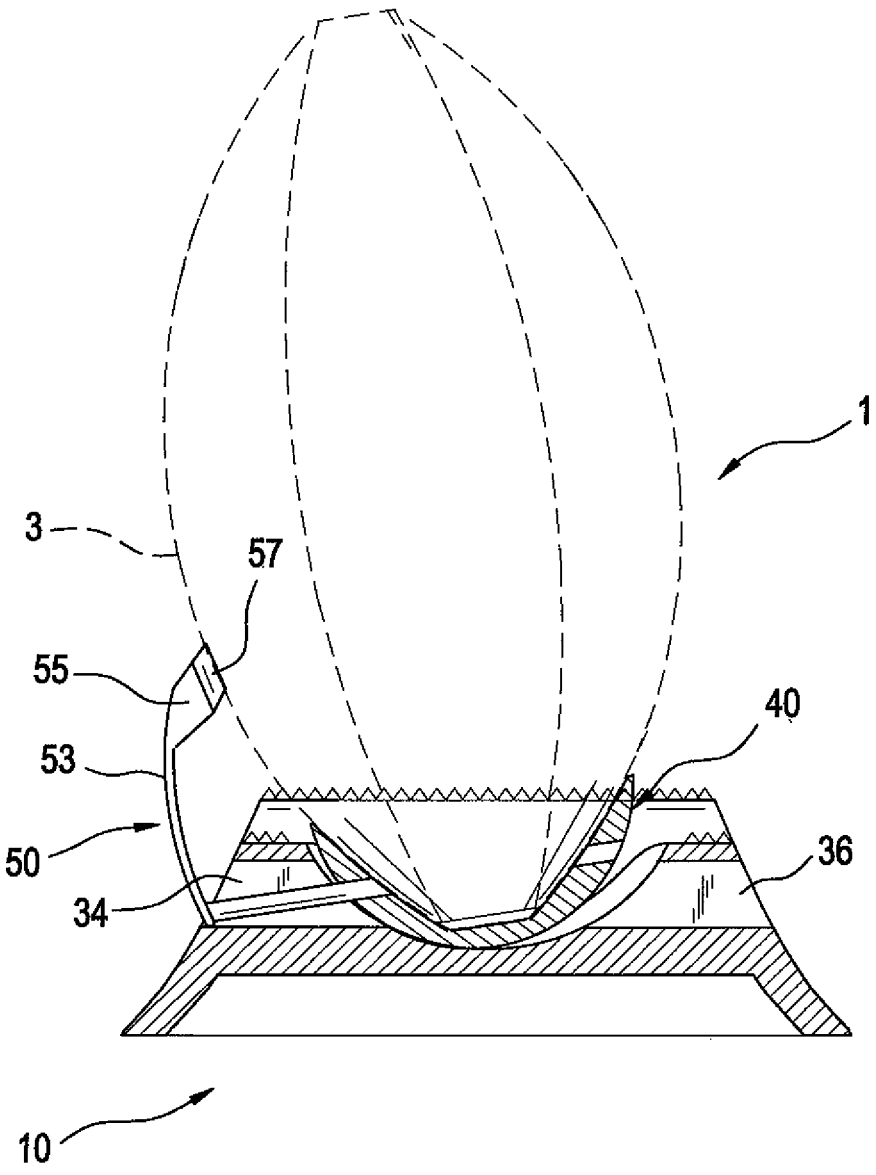
FIG. 13 shows a view similar to that of FIG. 7 but with the support structure pivoted in the left hand direction and with a football shown in phantom supported thereon.

FIG. 13 shows a view similar to that of FIG. 12 but with the support structure 40 pivoted in the opposite left hand direction with the arcuate arm 50 limited by engagement with the lower termination of the slot 34. As shown, the edge 57 engages a seam 3 of the football 1. This is similar to the view of FIG. 12 in which another seam 5 is engaged. This is also shown with reference to FIG. 11.

Figure 11:
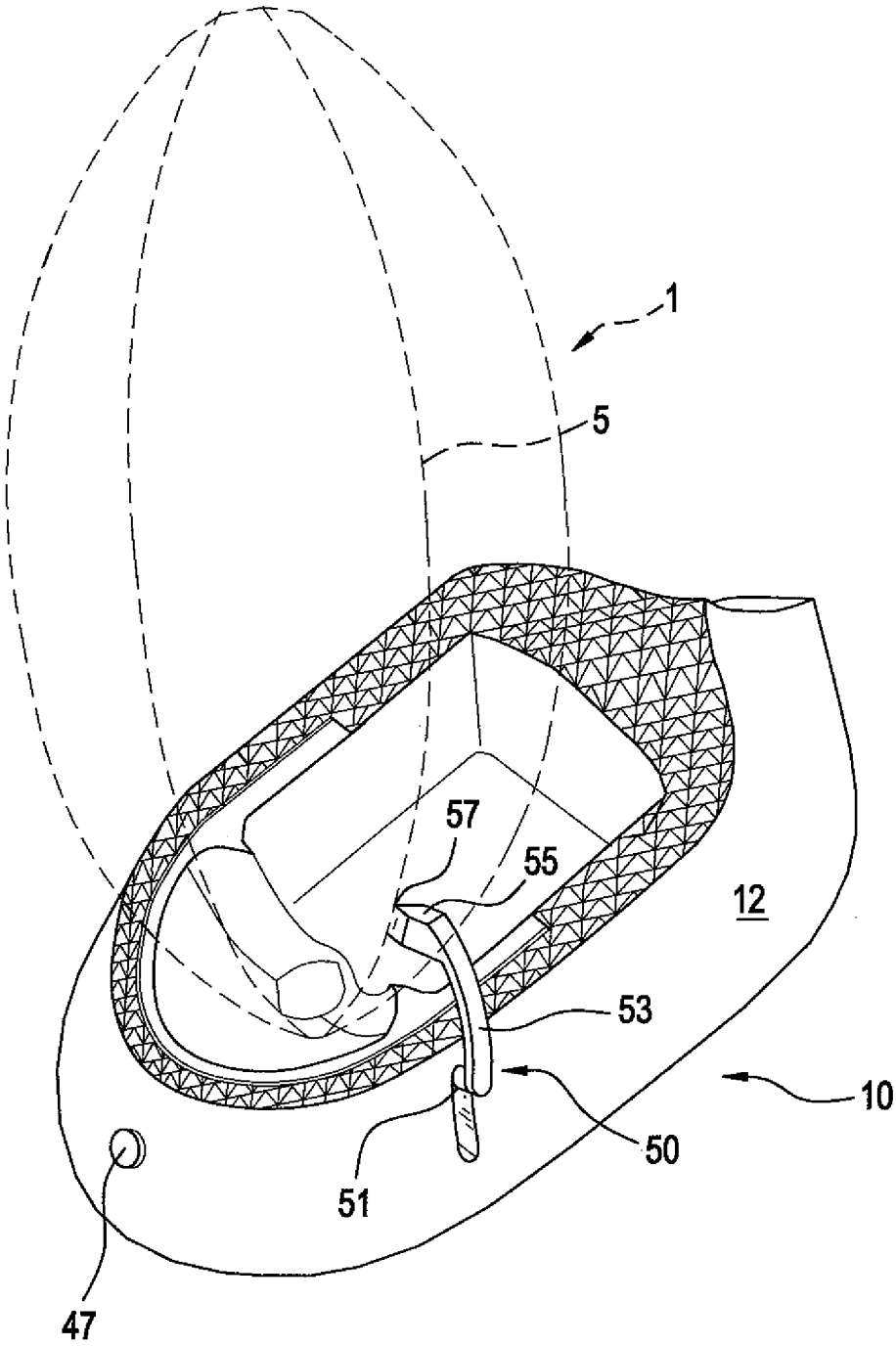
FIG. 11 shows a view similar to that of FIG. 1 but showing an image of a football in phantom supported on the inventive tee with the tee support structure oriented to support the football vertically.

As should be understood, in either configuration of the inventive tee 10 shown in FIGS. 11 and 13 as well as with respect to any lesser angulation adjustable only limited by the length of the slots 34 and 36, a football may be kicked with no resistance to such act from any structure of the inventive tee 10. In this regard, with particular reference to FIGS. 1, 4, 5 and 11-13, it should be understood that when the football 1 is kicked, it is conceivable that the foot of the kicker may engage any structure of the arcuate arm 50. Should this occur, the circular cross-sections of the stem or rod 51 and the hole 42 or 44 will allow the stem 51 to rotate within the hole 42 or 44 in the direction of the kick, thereby permitting the football 1 to freely leave the tee 10 with no resistance to that act from the tee 10.

Figure 14:
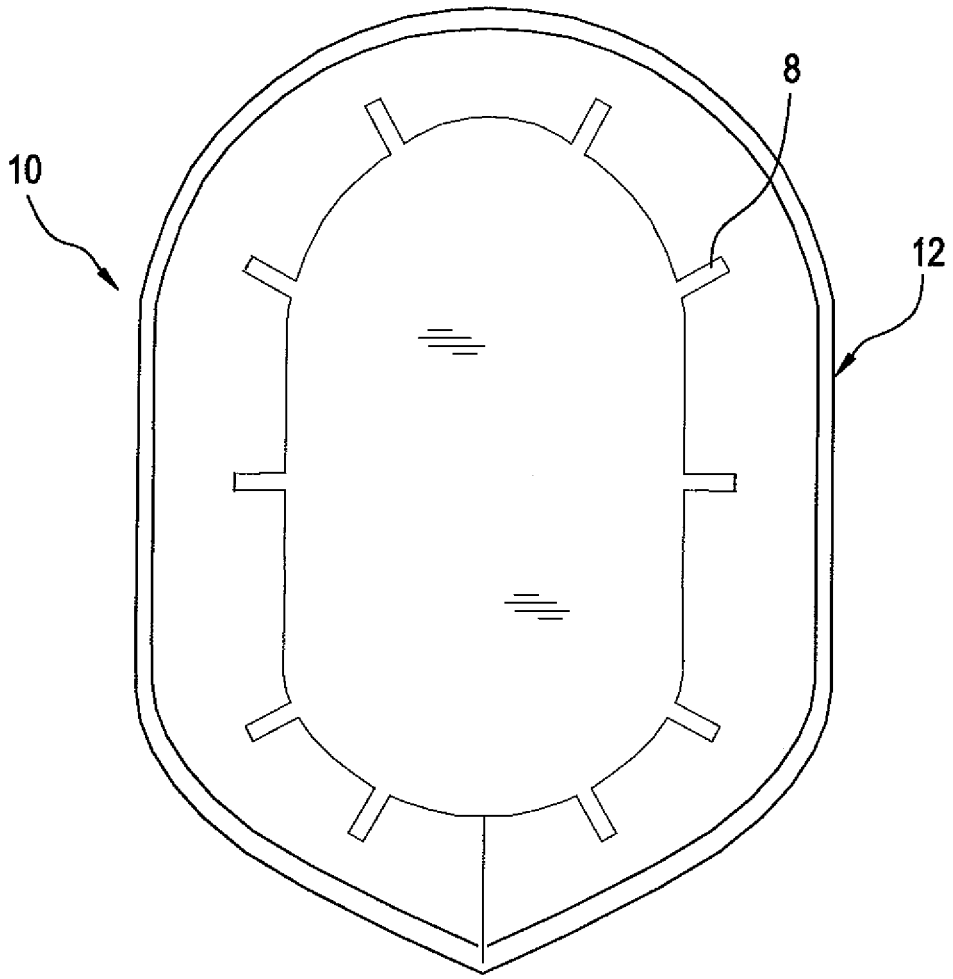
FIG. 14 shows a bottom view of the present invention.
Figure 15:
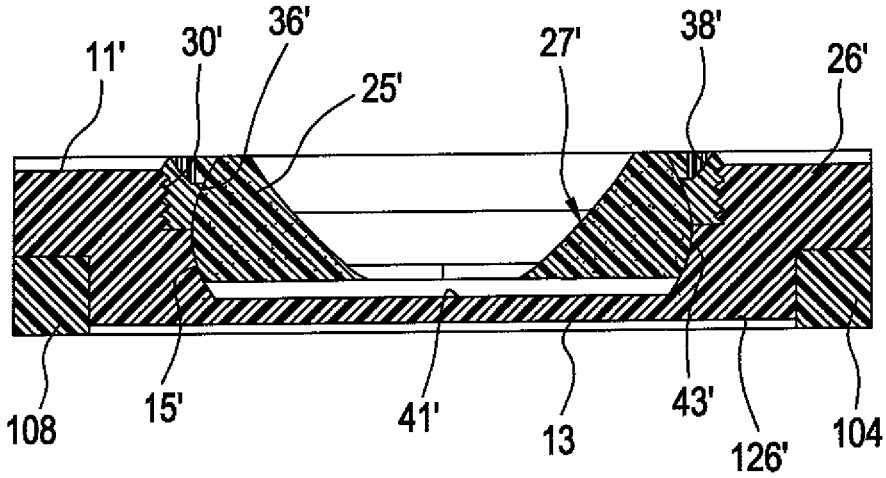
FIG. 15 PRIOR ART
FIG. 15 shows a cross-sectional view through a prior art configuration from U.S. Pat. No. 4,655,453 (FIG. 19) of which Applicant herein was a co-inventor.

The underside of the tee is seen in FIG. 14 and includes reinforcing portions 8 which are used to facilitate structural integrity during and after the preferred molding process.

In the preferred embodiment of the present invention, the structures of the tee, support structure, and arcuate arms may be suitably molded of rubber, plastic, Room Temperature Vulcanize (RTV) or any other suitable material. Metal is not preferred because it can be damaging to the football or to the foot of the user.

As such, an invention has been disclosed in terms of preferred embodiments thereof which fulfill each and every one of the objects of the invention as set forth hereinabove and provide a new and useful football tee with angularly adjustable ball support of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. An improved football tee, comprising:

a) a base supportable on a ground surface;

b) a support structure supported by said base for supporting an oblate spheroidal football, said support structure including a recess shaped in partial conformance with a shape of an oblate spheroidal football adjacent a tip thereof;

c) said support structure movable with respect to said base to adjust orientation of a football supported by said support structure with respect to said base; and d) a separate arm coupled to said support structure and having an end remote from said support structure and engageable with a surface of a football that is supported by said support structure, said surface engageable by said end of said arm being located further spaced from a tip of said football than portions of said football supported by said support structure, and said arm being movable with respect to said support structure.

2. The football tee of claim 1, wherein said support structure is pivotable with respect to said base.

3. The football tee of claim 2, wherein said base has a longitudinal axis from front to rear ends thereof, said support structure being pivotable about said axis to adjust tilt of a football supported by said support structure from a left hand tilt to a right hand tilt.

4. The football tee of claim 3, wherein said tilt is in a range of 0-10° in a left hand direction and 0-10° in a right hand direction.

5. The football tee of claim 3, wherein said arm is connectable to said support structure at a left hand side or a right hand side thereof.

6. The football tee of claim 5, wherein said arm is pivotably connectable to said support structure at said left hand side or right hand side thereof.

7. The football tee of claim 1, wherein said recess has a forward opening framed by a pair of flexible ribs, said opening connecting said recess to a further recess facilitating release of a football supported by said recess when kicked.

8. The football tee of claim 1, wherein said base has an elongated slot, said arm including a post connected to said support structure through said slot.

9. The football tee of claim 8, wherein a length of said slot acts as a limit stop limiting degree of movement of said support structure, and indicia adjacent said slot indicating degree of tilt of said support structure with respect to said base.

10. The football tee of claim 4, wherein said base has an elongated slot, said arm including a post connected to said support structure through said slot.

11. The football tee of claim 10, wherein said slot comprises a first slot, said first slot being vertically disposed at a left hand side of said base, and further including a second vertically disposed slot at a right hand side of said base, said post being connectable to said support structure through said first slot or said second slot.

12. The football tee of claim 11, wherein said post is pivotably connected to said support structure at either side thereof through said first slot or second slot.

13. The football tee of claim 7, wherein said further recess is at least partially within said base.

14. The football tee of claim 1, wherein said end of said arm has a distal edge engageable with a seam of a football supported by said support structure.

15. The football tee of claim 3, wherein said support structure has a first part cylindrical surface engaging a second part cylindrical surface on said base to facilitate pivoting of said support structure with respect to said base.

16. An improved football tee, comprising:

a) a base supportable on a ground surface;

b) a support structure supported by said base for supporting an oblate spheroidal football;

c) said support structure movable with respect to said base to adjust orientation of a football supported by said support structure with respect to said base; and d) an arm connected to said support structure and having an end engageable with a surface of a football supported by said support structure, said surface located spaced from a tip of said football, said base having an elongated slot, said arm including a post connected to said support structure through said slot, and said arm and post being movable with said support structure, said post being movable within said slot from a first end of said slot to a second end of said slot.

17. The football tee of claim 16, wherein said base has a longitudinal axis from front to rear ends thereof, said support structure being pivotable about said axis to adjust tilt of a football supported by said support structure from a left-hand tilt to a right hand tilt.

18. The football tee of claim 17, wherein said tilt is in a range of 0-10° in a left hand direction and 0-10° in a right hand direction.

19. The football tee of claim 17, wherein said arm is connectable to said support structure at a left hand side or a right hand side thereof.

20. An improved football tee, comprising:

a) a base supportable on a ground surface;

b) a support structure recessed within said base for supporting a tip of an oblate spheroidal football;

c) said support structure movable with respect to said base to adjust orientation of a football supported on a tip thereof by said support structure with respect to said base; and d) a separate arm coupled to said support structure and having an end remote from said support structure and engageable with a surface of a football that is supported by said support structure, said surface located spaced from said tip of said football, and said arm movable with respect to said support structure.

21. An improved football tee, comprising:

a) a base supportable on a ground surface;

b) a support structure recessed within said base for supporting a tip of an oblate spheroidal football;

c) said support structure movable with respect to said base to adjust orientation of a football supported on a tip thereof by said support structure with respect to said base; and d) an arm extending upwardly from said base and having an end remote from said base and said end being engageable with a first surface of a football remote from a second surface of said football that is supported by said support structure, said first surface being located spaced from said tip of said football, and said arm movable with respect to said support structure.

* * * * *